US010070726B2

(12) United States Patent
Curren et al.

(10) Patent No.: US 10,070,726 B2
(45) Date of Patent: Sep. 11, 2018

(54) TILE CHAIR

(71) Applicant: Andrew Curren, Torrance, CA (US)

(72) Inventors: Andrew Curren, Torrance, CA (US); Lowell Neset, Mt. Vernon, NY (US)

(73) Assignee: Andrew Curren, Torrance, CA (US)

( * ) Notice: Subject to any disclaimer, the term of this patent is extended or adjusted under 35 U.S.C. 154(b) by 259 days.

(21) Appl. No.: 14/943,929

(22) Filed: Nov. 17, 2015

(65) Prior Publication Data

US 2016/0135601 A1 May 19, 2016

Related U.S. Application Data

(60) Provisional application No. 62/081,438, filed on Nov. 18, 2014.

(51) Int. Cl.

| | |
|---|---|
| ***A47C 5/02*** | (2006.01) |
| ***A47C 4/28*** | (2006.01) |
| ***A47C 3/00*** | (2006.01) |
| ***A47C 4/30*** | (2006.01) |
| ***A47C 4/32*** | (2006.01) |
| ***A47C 4/42*** | (2006.01) |

(Continued)

(52) U.S. Cl.

CPC ..... *A47C 4/28* (2013.01); *A47C 3/00* (2013.01); *A47C 4/30* (2013.01); *A47C 4/32* (2013.01); *A47C 4/42* (2013.01); *A47C 5/00* (2013.01); *A47C 7/14* (2013.01); *A47C 5/02* (2013.01); *A47C 5/06* (2013.01); *A47C 7/024* (2013.01); *A47C 7/405* (2013.01)

(58) Field of Classification Search

CPC ..... A47C 5/06; A47C 7/405; A47C 7/024; A47C 5/02; A47C 4/28

USPC ..... 297/451.9, 16.1, 452.63, 452.64

See application file for complete search history.

(56) References Cited

U.S. PATENT DOCUMENTS 1,934,615 A * 11/1933 Selverstone ..... A47C 31/11 297/188.18

4,192,547 A 3/1980 Geier (Continued)

FOREIGN PATENT DOCUMENTS

| | | |
|---|---|---|
| CN | 1451341 | 10/2003 |
| JP | S1175983 | 3/1999 |

(Continued)

OTHER PUBLICATIONS

Zenithen IC544S-TV04 Bunjo Bungee Chair by Zenithen Limited, retrieved from website <http://www.amazon.com/Zenithen-IC544S-TV04-Bunjo-Bungee-Chair/dp/B00GM5S6X0> dated Feb. 12, 2016 (5 pages), publicly known prior to Nov. 18, 2014.

(Continued)

*Primary Examiner* — Syed A Islam

(74) *Attorney, Agent, or Firm* — Michael Best & Friedrich LLP

(57) ABSTRACT

A seat includes a frame defining an interior space bounded by an outer periphery. A fabric portion extends radially inward from the frame. A plurality of bands is engaged with the fabric portion and a plurality of support members is coupled to one or more bands of the plurality of bands. Each support member includes a connection member and a contact member secured to the connection member. The contact members cooperate to form a support surface spanning at least a portion of the interior space.

19 Claims, 14 Drawing Sheets

(51) Int. Cl.

| | |
|---|---|
| ***A47C 5/00*** | (2006.01) |
| ***A47C 7/14*** | (2006.01) |
| *A47C 7/02* | (2006.01) |
| *A47C 5/06* | (2006.01) |
| *A47C 7/40* | (2006.01) |

(56) References Cited

U.S. PATENT DOCUMENTS

| | | | | |
|---|---|---|---|---|
| 5,427,381 | A * | 6/1995 | Macaluso | A63B 63/004 273/400 |
| 5,503,455 | A * | 4/1996 | Yang | A47C 1/146 297/377 |
| 6,616,240 | B1 * | 9/2003 | Theosabrata | A47C 7/02 297/452.64 |
| 6,877,814 | B2 * | 4/2005 | Lin | A47C 4/02 297/440.1 |
| D677,920 | S | 3/2013 | Christakos | |
| D681,970 | S | 5/2013 | Christakos | |
| D688,057 | S | 8/2013 | Christakos | |
| 2014/0265458 | A1 | 9/2014 | Tseng | |
| 2015/0076888 | A1 * | 3/2015 | Xu | A63G 9/14 297/452.18 |

FOREIGN PATENT DOCUMENTS

| | | |
|---|---|---|
| JP | 200473332 | 9/2005 |
| KR | 1020050016345 | 2/2005 |

OTHER PUBLICATIONS

Blu Dot Super-Bungee Chair, retrieved from website <http://www.amazon.com/Blu-Dot-Super-Bungee-Chair/dp/B00IP1NQGG> dated Feb. 16, 2016 (6 pages), publicly known prior to Nov. 18, 2014.

International Search Report for Application No. PCT/US2015/061144 dated Mar. 8, 2016 (3 pages).

International Written Opinion for Application No. PCT/US2015/061144 dated Mar. 8, 2016 (3 pages).

* cited by examiner

TILE CHAIR

RELATED APPLICATIONS

This application claims priority to U.S. Provisional Application No. 62/081,438, filed Nov. 18, 2014, the entire contents of which are hereby incorporated by reference.

BACKGROUND

The present disclosure relates to a seat and more particularly to a tile seat or chair.

SUMMARY

In one embodiment a seat includes a frame defining an interior space bounded by an outer periphery. A fabric portion extends radially inward from the frame. A plurality of bands is engaged with the fabric portion and a plurality of support members is coupled to one or more bands of the plurality of bands. Each support member includes a connection member and a contact member secured to the connection member. The contact members cooperate to form a support surface spanning at least a portion of the interior space.

In one embodiment a seat includes a frame defining an interior space bounded by an outer periphery. A plurality of bands extends across at least a portion of the interior space and tensioned through direct or indirect interaction with the frame. A plurality of support members is positioned within the interior space, each support member at least partially supported by one or more bands of the plurality of bands.

In one embodiment a seat includes a frame and fabric assembly defining a seat opening. A flexible supporting structure at least partially spans the seat opening and is configured to support a user. The flexible supporting structure includes a suspension system having a plurality of bands and a plurality of support tiles. The plurality of bands is coupled to the frame and fabric assembly and the plurality of support tiles is coupled to and supported by the plurality of bands.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways. Also, it is to be understood that the phraseology and terminology used herein is for the purpose of description and should not be regarded as limiting.

DETAILED DESCRIPTION

Figure 1A:
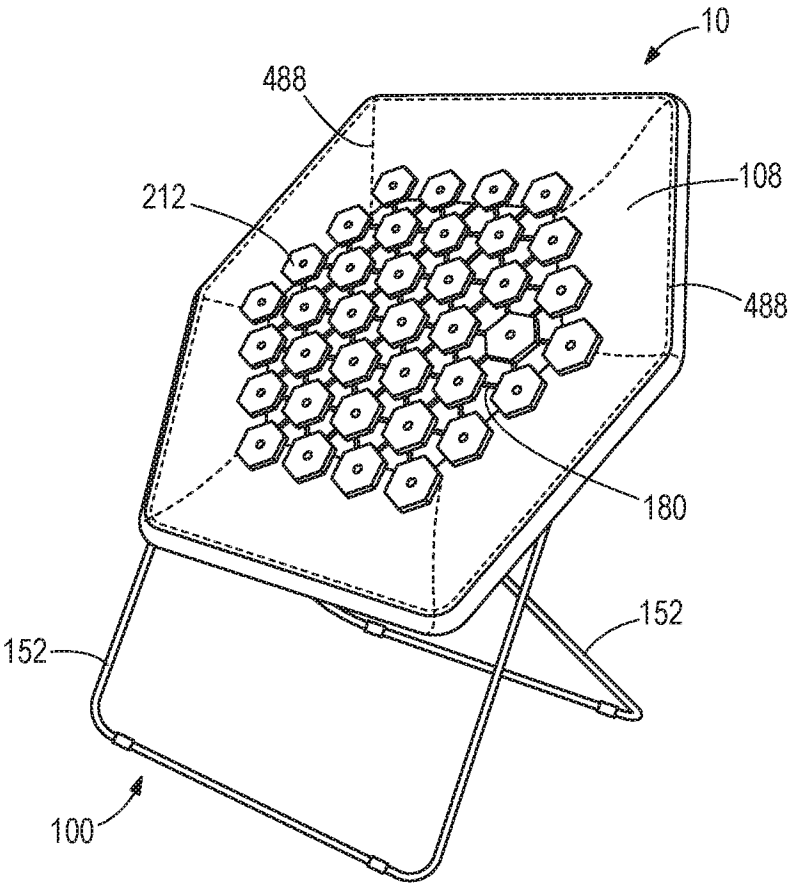
FIG. 1A is a perspective view of a seat having a plurality of support members or tiles.
Figure 1B:
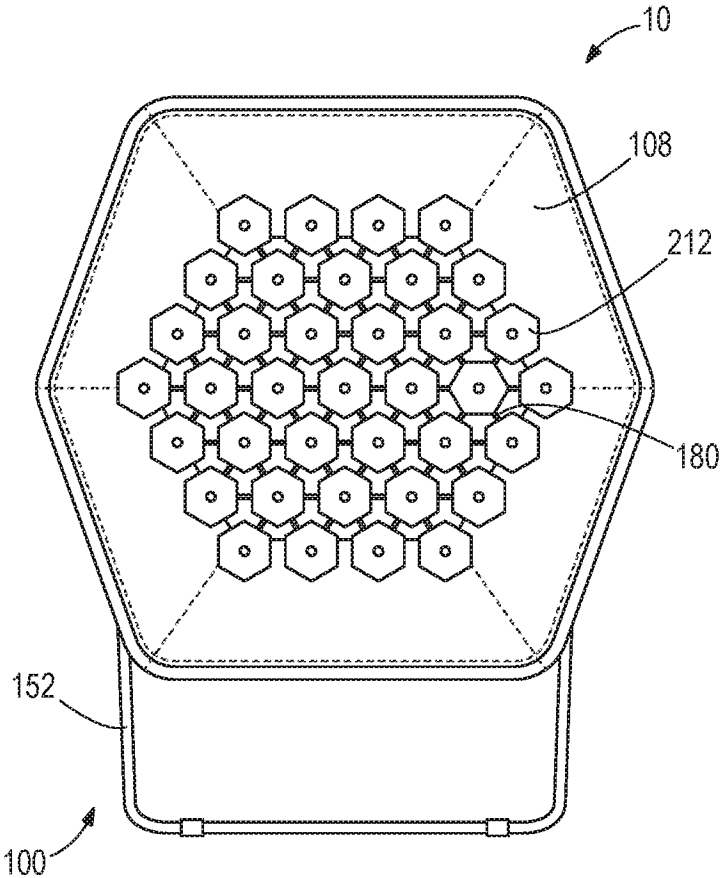
FIG. 1B is a front view of the seat of FIG. 1A.
Figure 2:
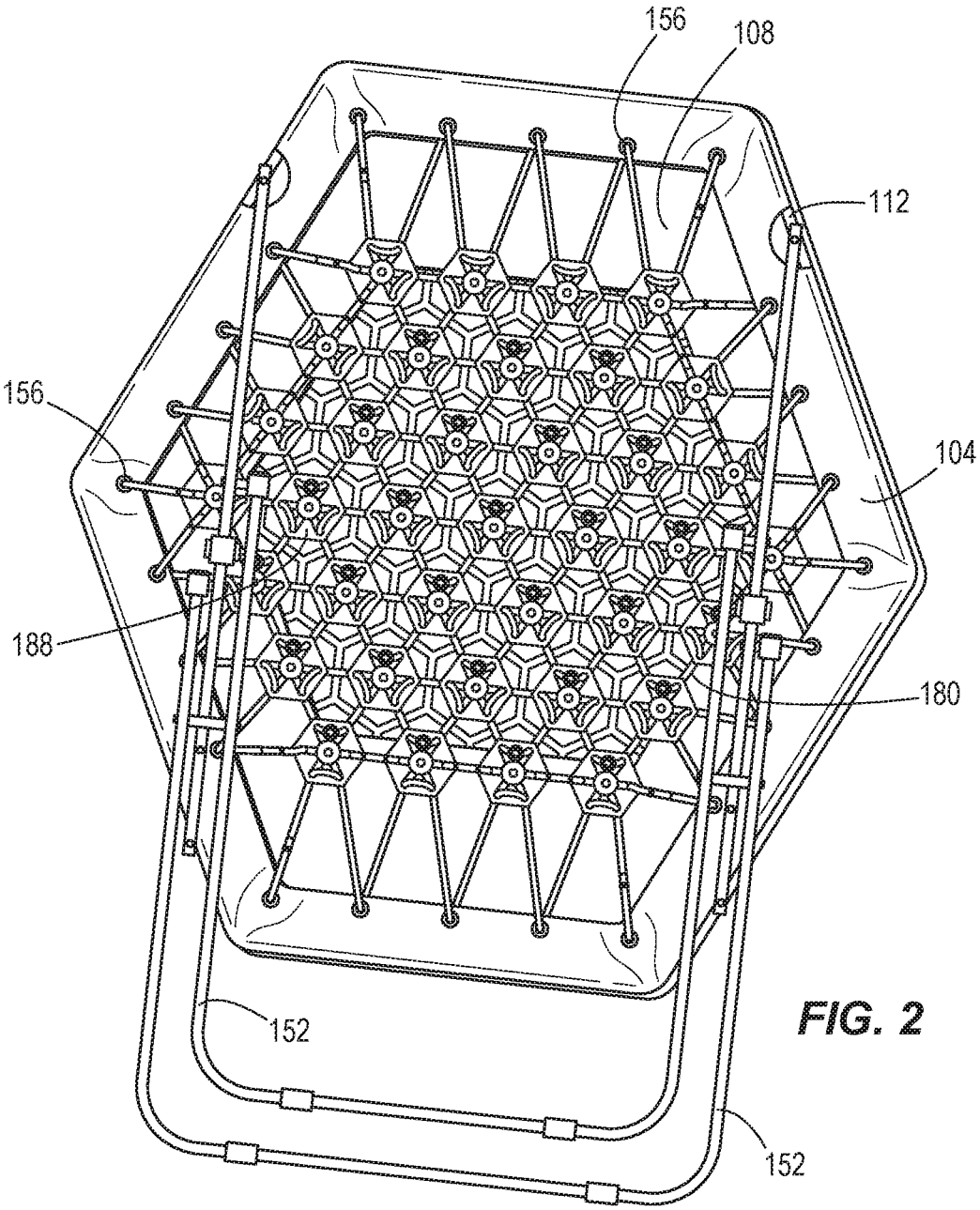
FIG. 2 is a rear view of the seat of FIG. 1A.

FIGS. 1A, 1B, and 2 illustrate a tile chair or seat 10 for supporting one or more users. The seat includes a frame and fabric assembly and a flexible supporting structure. The frame and fabric assembly comprises a frame 100, a first fabric portion 104 (FIG. 2), and a second fabric portion 108, which together define a seat opening. The flexible supporting structure includes a suspension system spanning the seat opening, and is explained in greater detail below.

Figure 4:
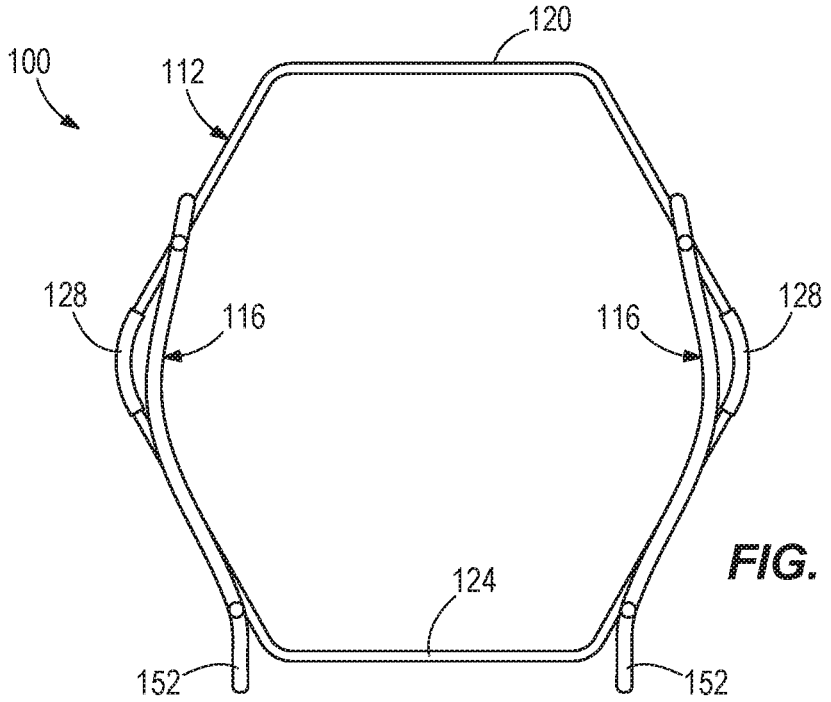
FIG. 4 is a rear view of a frame of the seat of FIG. 1A.

Referring also to FIG. 4, the frame 100 is generally hexagonal in shape, with or without rounded corners. Alternatively, the frame 100 can be any reasonable shape (circle, ellipse, polygon, pear-shape, etc.) and is constructed of a structural material (e.g., steel, aluminum, high strength polymer, etc.) capable of supporting the weight of the user. The frame 100 includes a base member 112 and a support assembly 116. The base member 112 of the frame 100 defines an interior space or aperture bounded by an outer periphery. As shown in FIG. 4, the base member 112 can be assembled from two equal halves, a top frame 120 and a bottom frame 124, connected by bent or arcuate couplers 128. Alternatively, the base member 112 can be assembled from two equal halves, a left frame and a right frame, connected by straight couplers located along upper and lower sides. The shape, size, quantity, and placement of the couplers is dependent on the shape of the frame 100. Alternatively, the frame 100 can be welded or bolted together or integrally formed as one piece, thereby requiring no coupler(s). The support assembly 116 is configured to support the user through ground contact and comprises two legs 152, each connected to the base member 112 and hinged to one another. This permits the legs 152 to transition between an open position, optimally used for sitting, and a closed position for moving and storage.

As shown in FIG. 2, the fabric portion 104 can be attached to the frame base member 112 and extends radially inward from the frame 100. A plurality of eyelets 156 within the frame fabric serve as mounting points for elastic cables 160.

As shown in FIGS. 1A-1B, the fabric portion 108 is a high elasticity, high strength material (e.g., relative to the fabric portion 104) that can be coupled directly to the frame base member 112 or may be attached to the frame fabric and therefore affixed about the frame base member 112. In the latter configuration, the base member 112 is positioned between fabric portion 104 and fabric portion 108, and an elastic cable (or cables) 160 extends between the eyelets 156 of the fabric portion 104 and the fabric portion 108 to reduce stresses within the fabric portion 108 and limit overstretching and tearing of the fabric portion 108. The fabric portion 104 and fabric portion 108, where applicable, are connected to the frame 100 through semi-permanent (e.g., screws, bolts) or permanent (e.g., welding, sewing) fastening techniques. The fabric portion 104 and/or the fabric portion 108 can be constructed from, for example, a spandex such as Lycra® or, as another example, from bengaline. Alternatively, either of the fabric portion 104 or the fabric portion 108 can be constructed from a less elastic polymer such as 600D polyester. In yet other embodiments, a natural fiber, e.g., canvas, can be used.

The fabric portion 108 extends a distance radially inward from the frame 100 and defines a centrally located seat opening 164 (FIG. 3), here embodied as a hexagonal shape, i.e., generally the same shape as the frame base member 112. The interior space defined by the base member 112 coincides, at least in part, with the opening 164. The shape of the opening 164 can mimic the shape of the frame 100, as shown in FIGS. 1A-1B, or may be embodied as a different shape (e.g., circle, ellipse, polygon, pear-shape, etc.).

The supporting structure spans the opening 164 and includes a plurality of elastic members such as cords, bands, or cables 180 (i.e., elastic members that stretch, expand, and/or flex, etc.) arranged with a plurality of support members or tiles.

The elastic members or cables 180 extend across the opening 164 defined by the fabric portion 108 (shown in greater detail with respect to FIGS. 16-19) and are tensioned through direct or indirect interaction with the frame 100. For example, the elastic cables 180 are supported by the fabric portion 108 through direct coupling to eyelets 182, e.g., through tying. Alternatively, a length of elastic cable 180 passes through the eyelets 182 and that length is thereby supported by fabric portion 108. The cables 180 entirely or partially span the opening 164, and may be intertwined or otherwise interconnected with one another across the opening 164.

Figure 18:
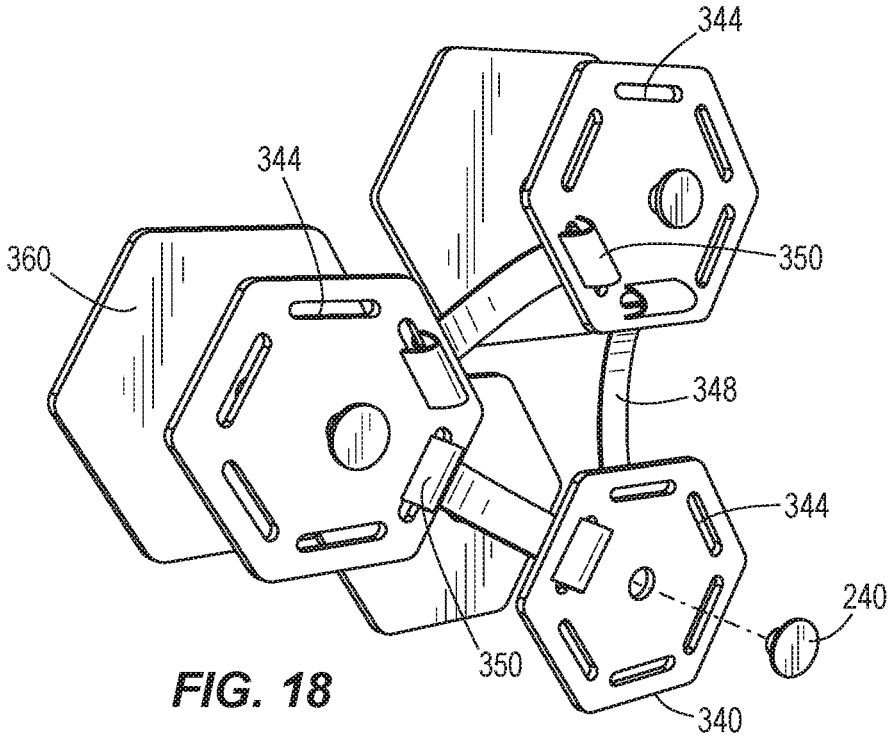
FIG. 18 is a perspective view of another type of tile and elastic cable arrangement.
Figure 19:
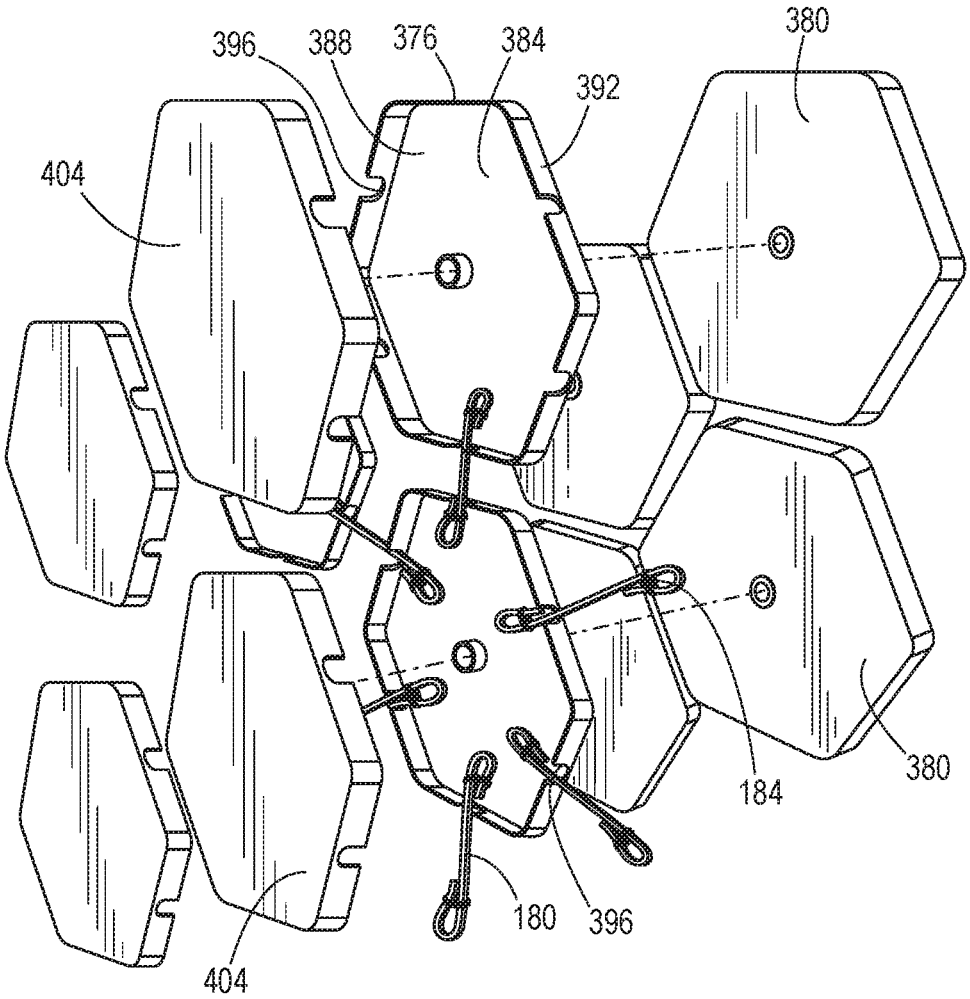
FIG. 19 is a perspective view of another type of tile and elastic cable arrangement.

One example of an elastic cable 180 is shown with respect to a plurality of support members or tiles in FIG. 19. The elastic cable 180 is made from a highly elastic material (e.g., rubber, bungee cord, etc.) capable of supporting, at least in tandem with other cables 180, the weight of the user. As shown in FIG. 19, the elastic cable 180 may be folded on each end to transform an original length to a folded length. The ends are held in place by metal clips 184. The cross-section of the elastic cable 180 is circular, however, alternative cross-sectional shapes may be used (e.g., rectangular, polygonal, ellipse, etc.). Other types of elastic cables are discussed with reference to FIGS. 14-18.

Figure 6:
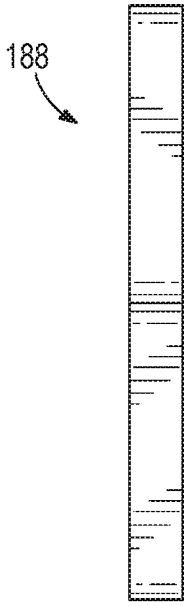
FIG. 6 is a side view of the rear tile of FIG. 5.
Figure 5:
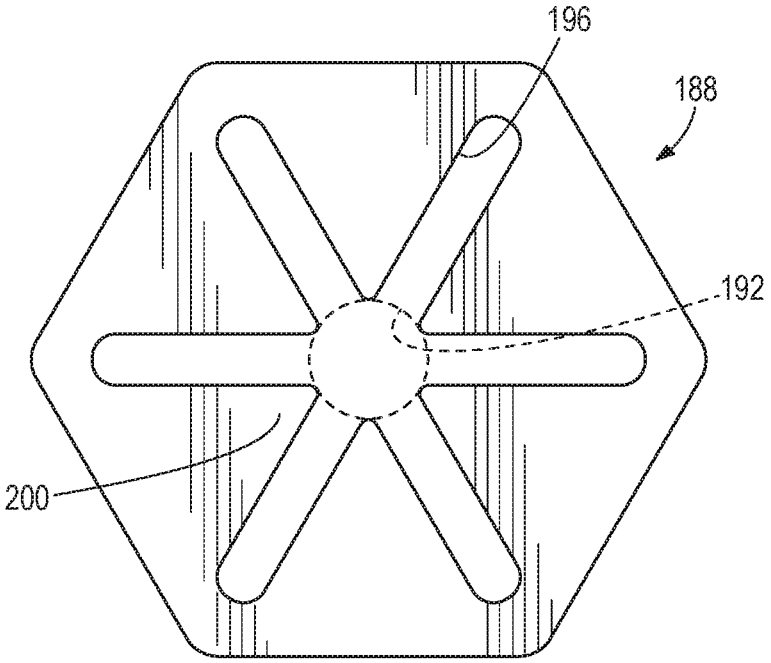
FIG. 5 is a front view of a rear tile.

Connection members or connection tiles 188 are associated with two or more elastic cables 180 and are located within the opening 164. As will be further described below, the connection tiles 188 join multiple elastic cables 180 and can be located at the intersection of multiple cables 180 or, alternatively, the connection tiles 188 can serve as a bridge between multiple elastic cables 180 at locations that are not intersections. FIGS. 5 and 6 show front and side views of a connection tile 188, respectively. The connection tile 188 contains a centrally located orifice 192 from which extend, radially outward, a plurality of slots 196. Two such slots 196 define therebetween a triangular section or protrusion 200, which provides a post or leg about which the elastic cables 180 can wrap or at which two cables 180 can be joined.

Figure 8:
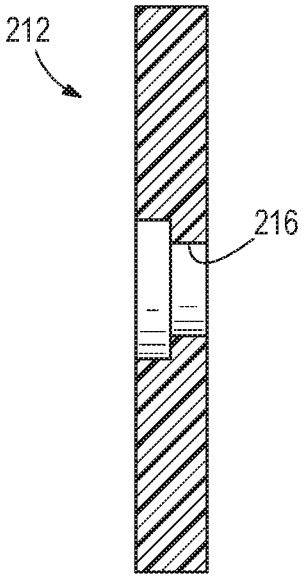
FIG. 8 is a side view of the front tile of FIG. 7.
Figure 7:
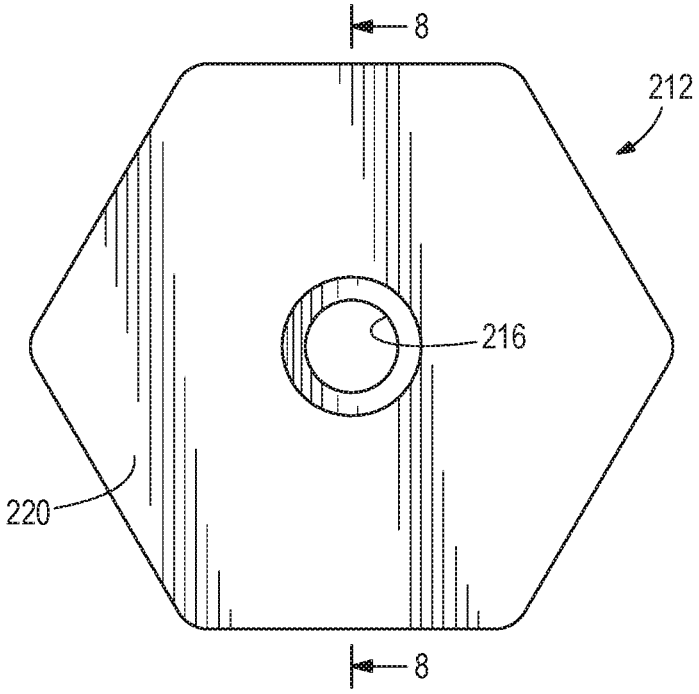
FIG. 7 is a front view of a front tile.

Each connection tile 188 backs a contact member or contact tile 212 that provides direct support, i.e., a contact surface, for the user. Collectively, the connection tile 188 and contact tile 212 form the support member. Referring to FIGS. 7-8, the contact tile 212 is shown as a hexagon with a centrally located orifice 216. FIG. 7 shows a front surface 220 of the contact tile 212, upon which the user rests. Collectively, the contact tiles cooperate to form a support surface which spans at least a portion of the interior space or opening 164 defined by the frame 100. As shown in FIG. 8, the orifice 216 does not have a constant bore diameter but rather comprises a through hole with a counter bore portion. The contact tile 212, or at least the front surface 220 of the contact tile 212, is made from a material (e.g., ethylene-vinyl acetate, elastomers, etc.) which provides a comfortable surface for the user to rest upon. The size and shape of the tiles 188, 212 can be highly variable, dependent upon the shape of the frame 100, the size of the seat 10, and aesthetic appeal among other considerations. Therefore, it is within the scope of the disclosure to use a polygonal, circular, elliptical, rectangular, or differently shaped tile 188, 212 amongst others.

Figure 3:
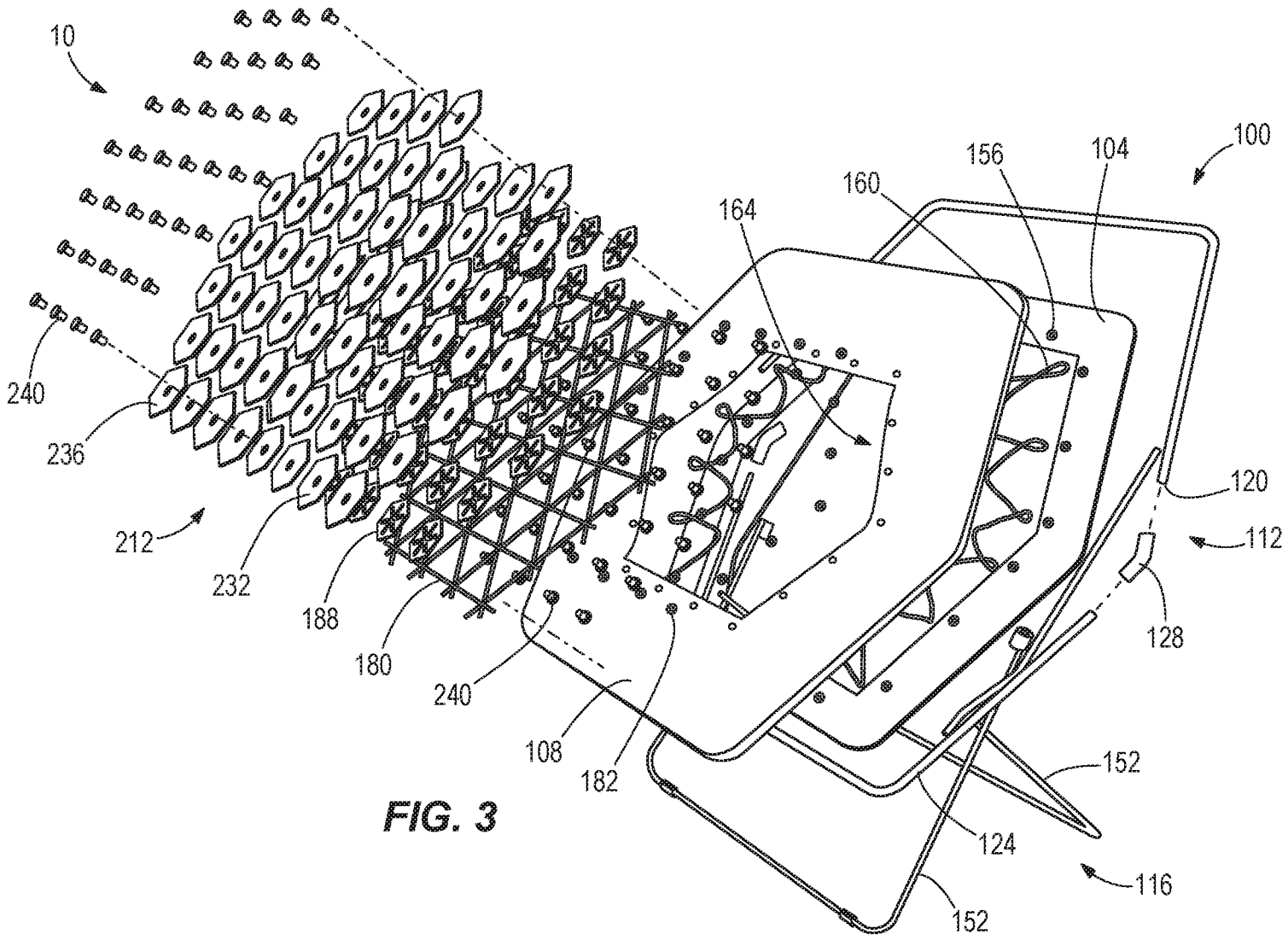
FIG. 3 is an exploded view of a seat having a plurality of support members or tiles.

The contact tiles 212 may be comprised of a single piece and material or, alternatively, as shown in FIG. 3, contact tiles 212 may be layered. In such a configuration, a bottom supporting tile 232 (not in direct contact with the seat user) may provide structural rigidity while a top supporting tile 236 may be comprised of a more comfortable (e.g., softer, decreased surface roughness) or more aesthetically pleasing material or shape. Each of the bottom supporting tile 232 and the top supporting tile 236 contains a centrally located orifice 216 therethrough.

Figure 9:
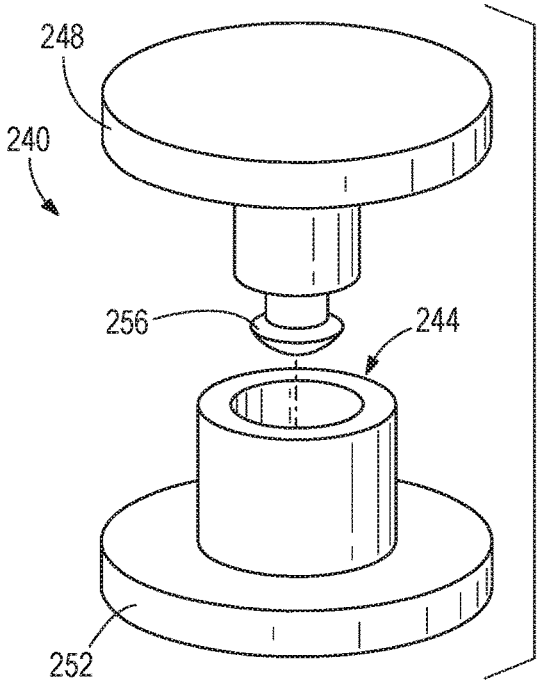
FIG. 9 is a perspective view of a tile clasp in an unengaged position.
Figure 11:
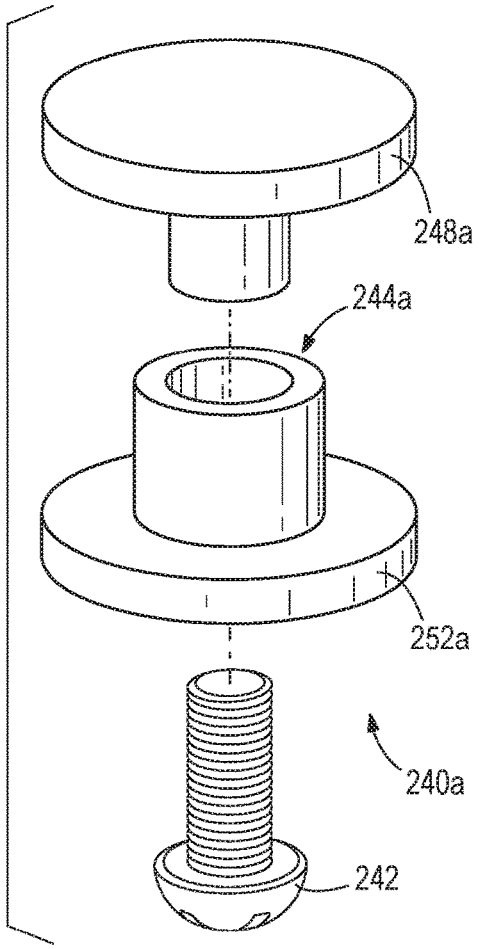
FIG. 11 is a perspective view of an alternative tile clasp and fastener.
Figure 10:
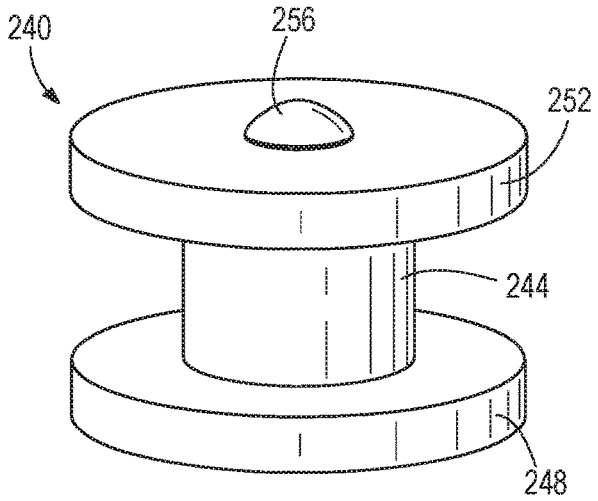
FIG. 10 is a perspective view of the tile clasp of FIG. 9 in an engaged position.

The contact tiles 212 are coupled or connected to the connection tiles 188 via a two-part link 240, **240*a* which extends through the centrally located orifices 192, 216. Examples of exemplary links 240, 240*a* are shown in FIGS. 9-11. The link 240, 240*a* is a two-piece spool with an assembled diameter at the center 244, 244*a* smaller than either of the spool ends 248, 252 (248*a*, 252*a* with respect to FIG. 11) and smaller than the orifices 192, 216 of the contact tile 212 and the connection tile 188. About one half of the link 240, 240*a* is positioned above or in front of the contact tile 212 and the other half of the link 240, 240*a* is positioned below or in back of the connection tile 188. The two halves of the link 240 mate (e.g., press-fit, twist-locking fit) with one another to hold the tiles 188, 212 in place. More specifically, one of the two halves shown in FIGS. 9-10 includes a protrusion with a snap feature 256. The snap feature 256 includes an angled or slanted surface and a flat surface configured to mate with a flat surface of the other half when assembled. The slanted surface permits easy assembly with the other half of the link 240** while the flat surface prevents disassembly. The two halves of the link

240*a* mate with one another and are further fixed to one another via a fastener 242 such as a screw or a bolt. The counter bore portion of the contact tile 212 permits the link to sit flush or nearly flush with the front surface 220 of the contact tile 212.

Figure 13:
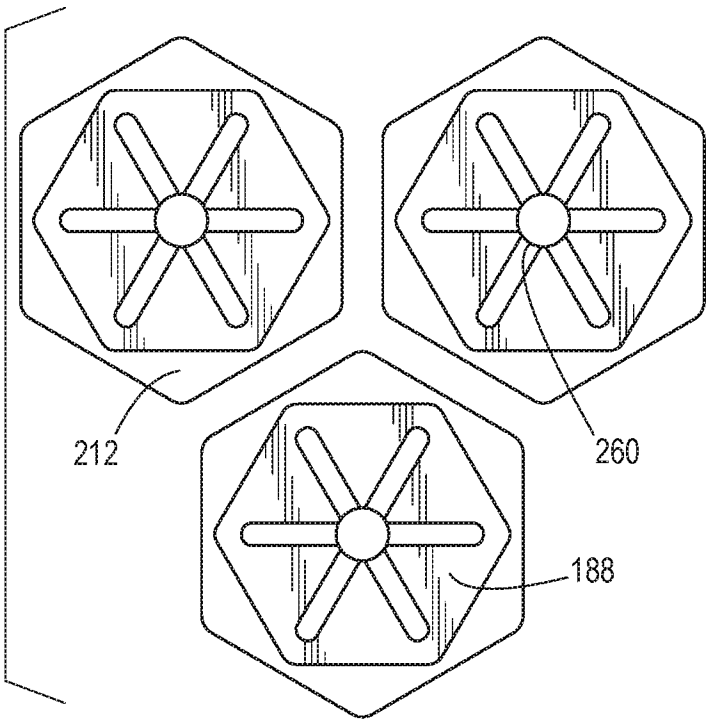
FIG. 13 is a rear view of a plurality of front and rear tiles in a second orientation.
Figure 12:
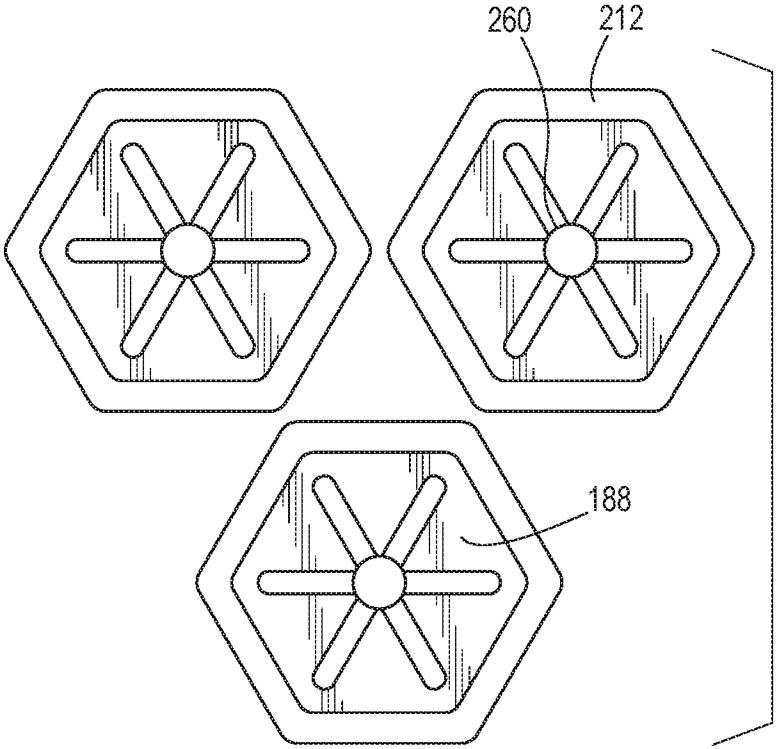
FIG. 12 is a rear view of a plurality of front and rear tiles in a first orientation.
Figure 20:
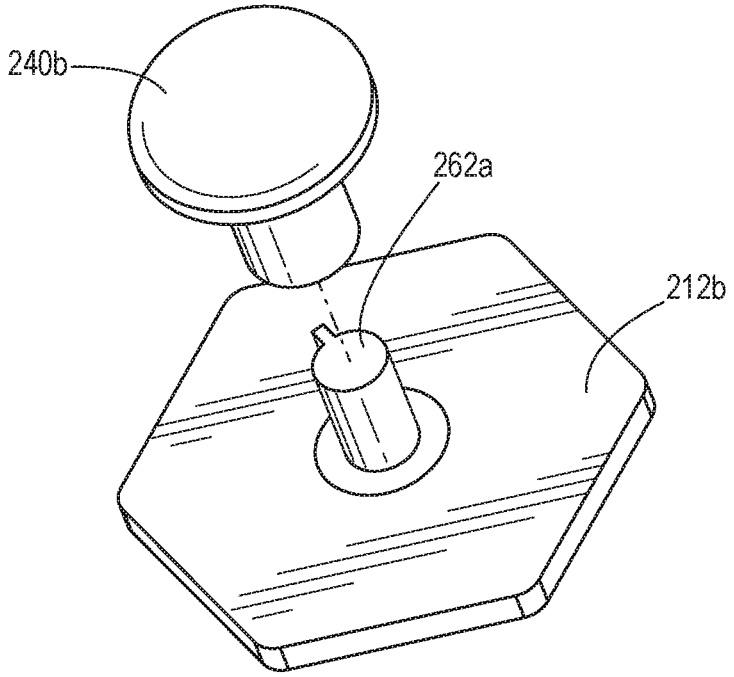
FIG. 20 illustrates a keyway locking feature, the keyway located in the tile clasp.
Figure 21:
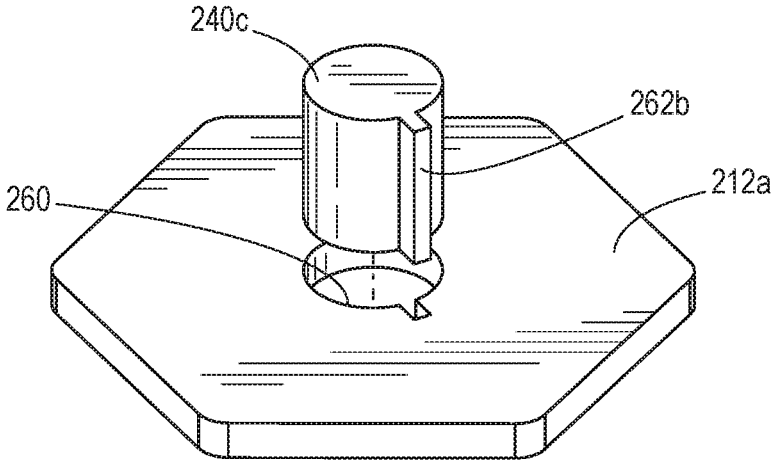
FIG. 21 illustrates a keyway locking feature, the keyway located in the tile.

A link 240*b*, 240*c* can also contain a keyway locking feature to prohibit rotation of the contact tile 212 relative to the connection tile 188. Specifically, as shown in FIGS. 20-21, the keyway 260 can exist within the contact tile 212*a* and/or the link 240*b*. A key 262*a*, 262*b* prohibits rotation of the tiles 188, 212 (or, in place of 212: 212*a*, 212*b*) relative to one another when the suspension system is in the fully assembled state. Multiple keyways 260 may exist within each of the tiles 188, 212 to allow for multiple tile orientations. Referring to FIG. 12, one assembly can require that tiles 188, 212 be placed corner-to-corner (i.e., the corners of adjacent tiles are directly adjacent one another) orientation. In order to lock the contact tile 212 in place, the key 262 is inserted and held in place with a link 240. Alternatively, the contact tile 212 can be rotated into a face-to-face (i.e., the edges of adjacent tiles are parallel to one another) or cluster orientation, as shown in FIG. 13 and similarly locked in place. FIG. 12 shows a final assembly in the corner orientation and FIG. 13 shows a final assembly in the cluster orientation. Other systems for locking the orientation of the contact tiles 212 uniformly or non-uniformly are of course contemplated by the presently described supporting structure. The contact tile 212 can be oriented in various alternative positions with respect to the connection tile 188, which is fixed when connected to the cables 180.

In some applications, the tiles 212, 188 serve as a supporting base for an overlay material, examples of which may include an artificial fur, microfiber, or other sheet material suitable as a contact surface. In yet other applications, the contact tile 212 can be stamped, marked, or otherwise imprinted with a design, logo, character, or other visible feature.

Figure 16:
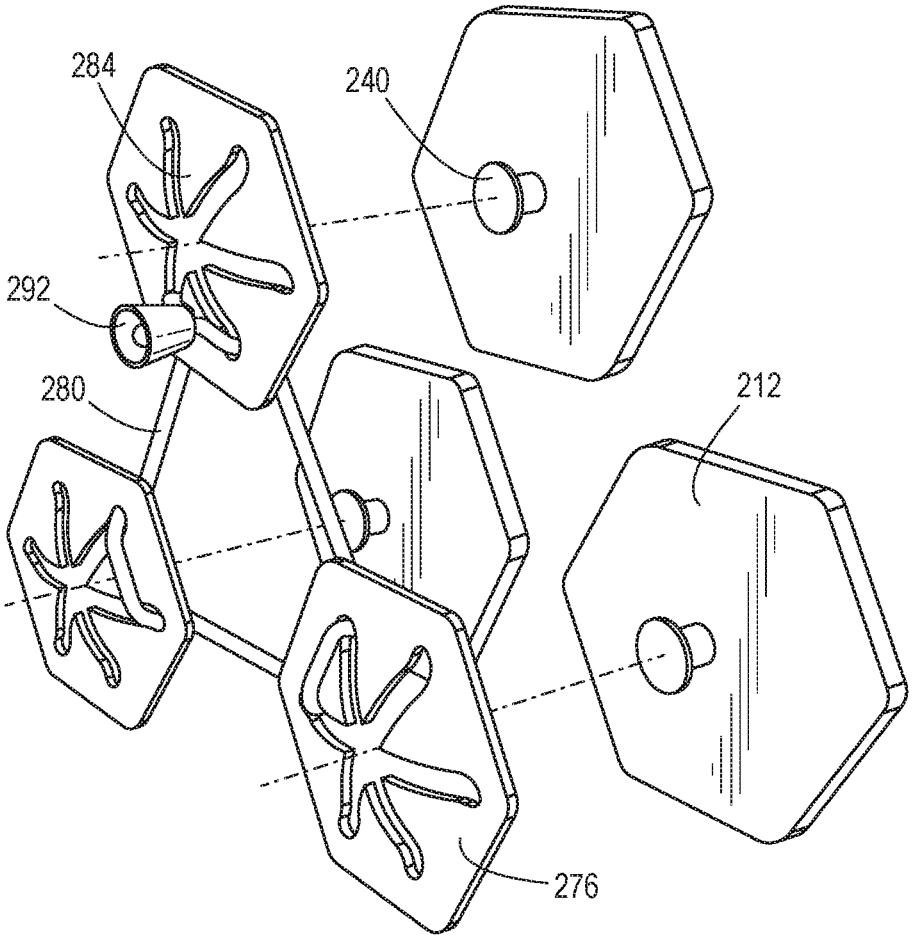
FIG. 16 is a perspective view of one type of tile and elastic cable arrangement.

FIGS. 16-19 show various suspension systems which include at least one aperture sized to accept one or more of the plurality of bands. FIG. 16 show a suspension system assembly method utilizing a plurality of flared connection tiles 276, looped elastic cables 280, and contact tiles 212. The flared connection tiles 276 are similar to the connection tiles 188 of FIGS. 5-6; however, the posts 284 flare out as they progress radially inward. In this embodiment, the looped elastic cable 280 is formed by connecting both ends of a single strand cable 288 into a bell-shaped end cap 292. The elastic cable 280 is wrapped about three posts 284, one from each of three adjacent connection tiles 276. Each of the connection tiles 276 is secured to its respective contact tile 212, thereby trapping the elastic cable 280 about the posts 284. In the current embodiment, a corner orientation is formed by wrapping the elastic cable 280 about an odd number of posts. Alternatively, the looped elastic cable 280 can be wrapped about an even number of posts to create a cluster orientation (not shown).

Figure 14:
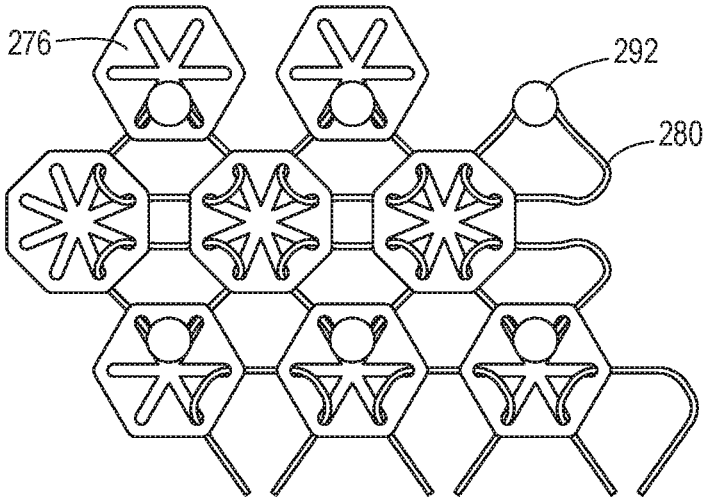
FIG. 14 is a rear view of a plurality of rear tiles connected to one another by looped cables.
Figure 15:
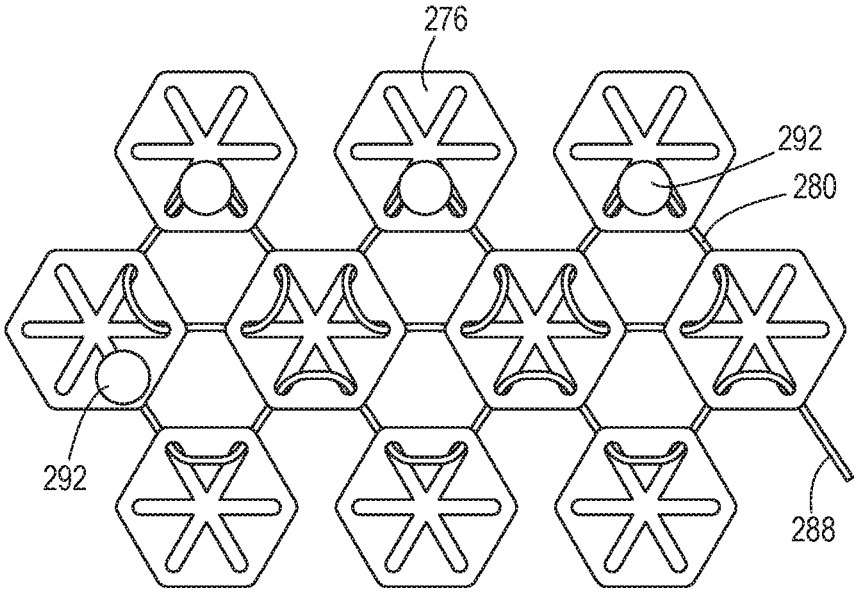
FIG. 15 is a rear view of a plurality of rear tiles connected to one another by looped and un-looped cables.

FIG. 14 shows the assembly of the connection tiles 276 and elastic cables 280 of FIG. 16 with a larger number of connection tiles 276. FIG. 15 shows a similar orientation over half of the connection tiles 276 and a zigzag cable pattern across the other half of the connection tiles 276. The zigzag pattern utilizes one or more single strand elastic cables 288 as opposed to the looped cable 280. The single strand cable 288 can follow any pattern across any number of the tiles 276, and in some embodiments every tile 276 can be connected with a single cable 288.

Figure 17:
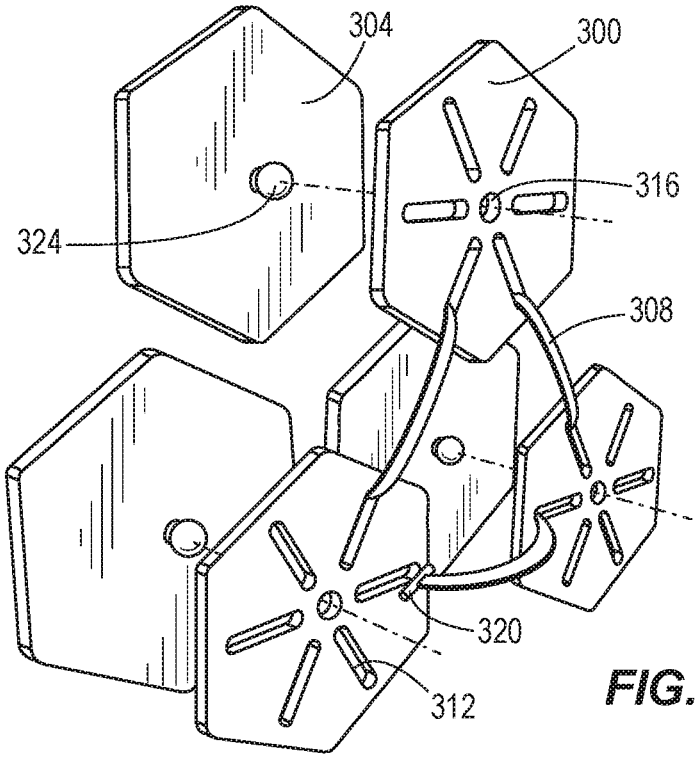
FIG. 17 is a perspective view of another type of tile and elastic cable arrangement.

Another example of an assembly method of the supporting structure is shown in FIG. 17. The assembly consists of a plurality of connection tiles 300, contact tiles 304, and elastic cables 308. In comparison to the connection tiles 188 of FIGS. 5-6, the slots 312 of the connection tiles 300 do not extend from the central orifice 316. Therefore, the elastic cables 308, which connect one connection tile 300 to another, are single strand cables 288 with elongated end caps 320. The elongated end caps 320 are configured to extend through the slots 312 and rotate into a locked position. Alternatively, many different shapes, including a bell-shaped end cap, similar to the end cap used with respect to the assembly method of FIG. 16, may be used, and in some applications cables such as cables 180 with folded ends as previously described maintain connections between adjacent tiles. Each of the contact tiles 304 of FIG. 17 is shown with a centrally located protruding post 324 to match up with the centrally located orifices 316 of the connection tiles 300. The posts 316 can utilize a press fit or may be threaded to the connection tile 300 or to a nut located on the back side of the connection tile 300. In the assembled state, the system of FIG. 17 has a cluster orientation.

Referring to FIG. 18, each connection tile 340 includes slots 344 extending parallel to the periphery of the connection tile 340, as opposed to slots extending radially outward from the center. The elastic cables are shown as ribbon cables 348 and extend into the slots 344 with hook ends 350 that pass through the slots 344 to hold the tiles 340 in place. The hook end 350 rests within the opening thereby suspending the tile 340 with the tension of the elastic cables 348. Contact tiles 360 are coupled to the connection tiles 340 with links 240 or through other means.

As shown in FIG. 19, another supporting structure assembly comprises elastic cables 180, and a plurality of connection tiles 376 and contact tiles 380. In comparison to the aforementioned connection tiles 188, the connection tiles 376 do not contain openings along the hexagonal surface 384. Instead, the connection tiles 376 present a hollow 388 defined by a peripheral wall 392 extending perpendicular to the hexagonal surface 384. The wall 392 contains a plurality of openings 396 through which the associated elastic cable 180 is configured to extend. The folded ends of the elastic cable 180 are located within the hollow 388. To prevent the elastic cable 180 from translating within the openings 396, the loop created in the folded end of the elastic cable 180 may be wrapped about a post (not shown) located within the hollow 388, or the metal clip 184 may rest within the sidewall opening 396. A second connection tile 404 can close off, cover, or overlay the hollow 388 of the connection tile 376, forming a volume therein to contain the ends of the cable 180. In some embodiments, the contact tile 380 also includes a peripheral wall configured to overlap the peripheral wall 392 of the connection tile 376 when positioned together to form a volume therein to contain the ends of the cable 180. When closed or covered by the second connection tile 404 or the contact tile 380, the ends of the elastic cables 180 are not capable of fitting through the sidewall openings 396.

Figure 22:
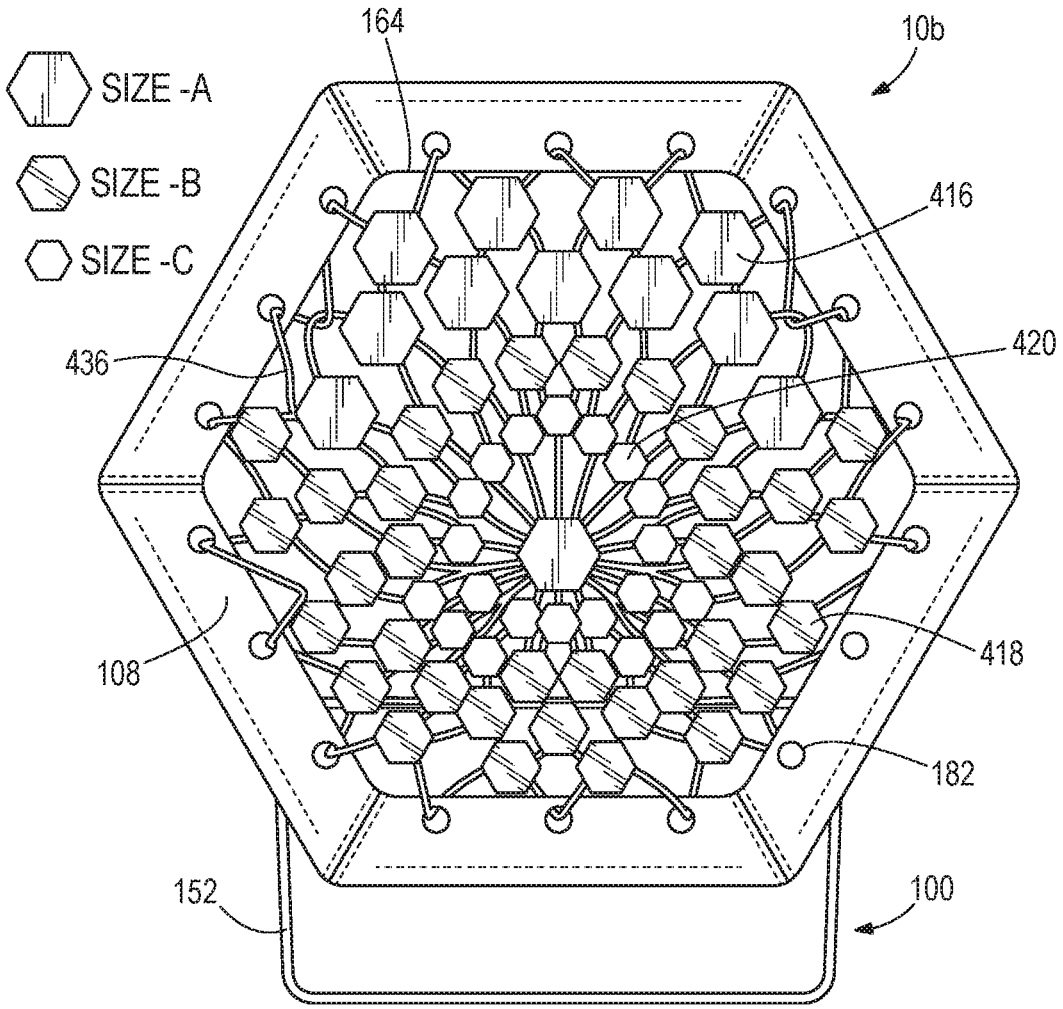
FIG. 22 is a front view of a seat having another tile orientation with various tile sizes.
Figure 24:
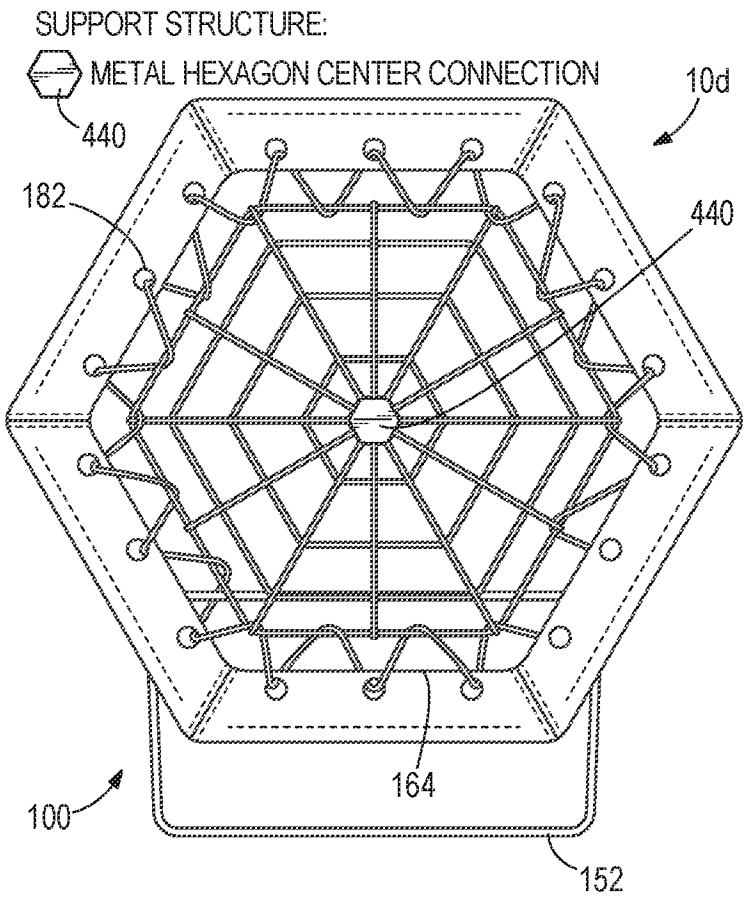
FIG. 24 is a front view of a seat with an alternative central support structure.
Figure 23:
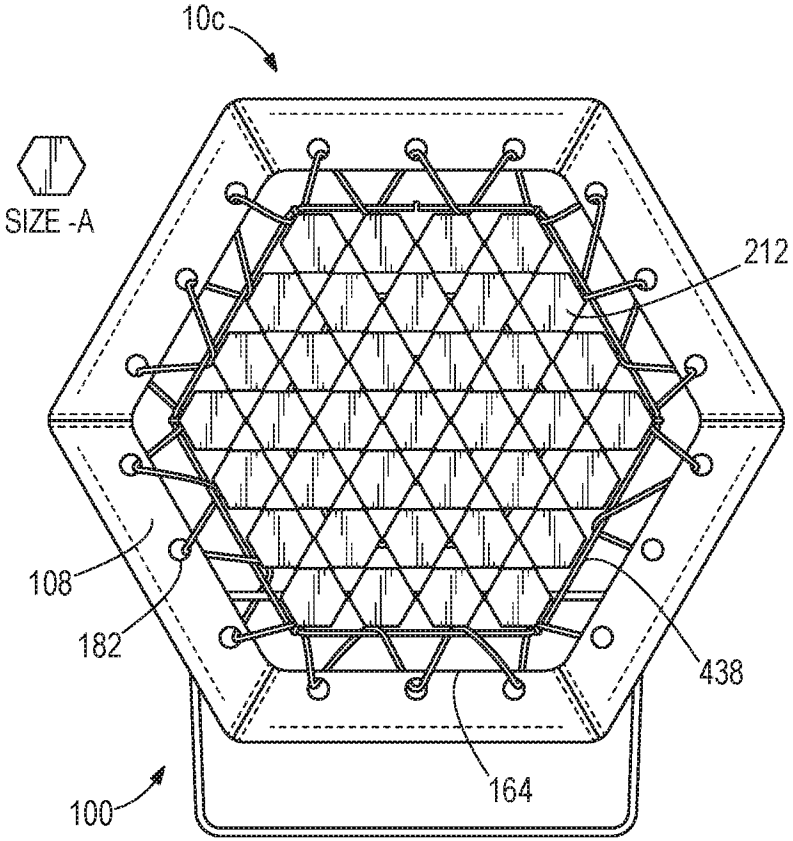
FIG. 23 is a front view of a seat with an alternative peripheral support structure.

FIGS. 22-24 illustrate additional features which may be included in any of the embodiments shown in the previous and remaining figures. FIG. 22 shows a seat 10*b* including an elastic cable and tile design that centers about a point lower than the geometric center of the opening 164 to more directly support a lower position of the seated user. Additionally, multiple tile sizes 416, 418, 420 (contact tile and underlying connection tile) and tile spacing can be used to accommodate multiple cable patterns and types (see, e.g., cable 436). Further, even larger tiles (e.g., with a size greater than 5% of the opening 164) and tiles of non-uniform shapes can be used to provide support for the user. The seat 10*c* of FIG. 23 includes a separate frame component 438 within the suspension structure radially inward of the peripheral fabric 108. The frame component 438 is composed of a structurally robust material (e.g., steel, aluminum, etc.) and provides additional support for the user. The seat 10*d* of FIG. 24 utilizes a central metal hexagon 440 to improve the strength of the support or suspension system.

The connection and contact tiles do not need to be located at the intersection of the elastic cables. The connection and contact tiles can alternatively or additionally connect to (e.g., snap to, adhere to, etc.) the elastic cables along the length of the cables. Further, not every intersection of the elastic cables 180 requires a tile. The pattern of the elastic cables 180 does not necessarily need to match the shape of the frame 100 or remain constant throughout the opening 164 (see FIG. 22). With a hexagonal frame the cables may alternatively extend horizontally, vertically, or diagonally across the opening.

The contact tile may have various designs including floral designs, sports-shaped tiles such as footballs, basketballs, soccer, tennis or golf balls, animal shapes, transportation (plane, car) shapes, musical shapes, letters or words, or a shape derived from popular culture, to name a few non-limiting variations. The fabric portion 108 may contain a design to match or enhance the tile 212, such as a matching theme or color design. Further, a stitching pattern 488 can be added (FIGS. 1A-1B), which may at least partially attach the fabric portion 108 to the frame 100 of the seat 10, but can also serve as an aesthetic accent.

The invention claimed is:

1. A seat comprising:

a frame defining an interior space bounded by an outer periphery;

a fabric portion extending radially inward from the frame;

a plurality of bands engaged with the fabric portion; and a plurality of support members, each of the support members coupled to one or more bands of the plurality of bands;

wherein each support member comprises a connection member and a contact member secured to the connection member, and wherein the contact members cooperate to form a support surface spanning at least a portion of the interior space.

2. The seat of claim 1, wherein each connection member is coupled to one or more bands of the plurality of bands.

3. The seat of claim 1, wherein the fabric portion is a first fabric portion, and further comprising a second fabric portion extending inward from the frame, the second fabric portion less elastic than the first fabric portion, wherein at least some of the bands of the plurality of bands are engaged with the second fabric portion.

4. The seat of claim 1, wherein each connection member includes an aperture sized to accept one or more bands of the plurality of bands.

5. The seat of claim 1, wherein the fabric portion includes a plurality of eyelets, and wherein the plurality of bands is indirectly engaged to the frame via the plurality of eyelets.

6. A seat comprising:

a frame defining an interior space bounded by an outer periphery;

a plurality of bands extending across at least a portion of the interior space and tensioned through direct or indirect interaction with the frame; and a plurality of support members positioned within the interior space, each support member at least partially supported by one or more bands of the plurality of bands, and each support member including a planar surface to collectively form a support surface spanning at least a portion of the interior space, wherein each support member of the plurality of support members comprises a connection member coupled to one or more bands of the plurality of bands, and a contact member coupled to the connection member and presenting the planar surface, wherein the contact members cooperate to form the support surface spanning at least a portion of the interior space.

7. The seat of claim 6, further comprising a plurality of legs attached to the frame and configured to support the frame.

8. The seat of claim 6, wherein the contact member is coupled to the connection member via a fastener.

9. The seat of claim 6, wherein the contact member is coupled to the connection member such that the contact member cannot rotate relative to the connection member.

10. The seat of claim 6, further comprising a fabric portion extending at least partially into the interior space, wherein the plurality of bands is directly or indirectly engaged with the fabric portion.

11. The seat of claim 10, wherein the fabric portion is a first fabric portion, and further comprising a second fabric portion extending inward from the frame, the second fabric portion less elastic than the first fabric portion and including a plurality of eyelets, wherein at least some bands of the plurality of bands pass through the eyelets.

12. The seat of claim 6, wherein each support member of the plurality of support members includes at least one protrusion about which one band of the plurality of bands wraps.

13. The seat of claim 6, wherein each support member of the plurality of support members includes at least one aperture sized to accept one or more bands of the plurality of bands.

14. The seat of claim 6, wherein each of the connection members includes at least one protrusion about which one band of the plurality of bands wraps.

15. The seat of claim 6, wherein the support members comprise a material less elastic than the plurality of bands.

16. A seat comprising:

a frame and fabric assembly defining a seat opening; and a flexible supporting structure at least partially spanning the seat opening and configured to support a user, wherein the flexible supporting structure includes a suspension system having a plurality of bands and a plurality of support tiles, wherein the plurality of bands is coupled to the frame and fabric assembly, wherein each support tile of the plurality of support tiles is coupled to and supported by at least some bands of the plurality of bands, and wherein each support tile of the plurality of support tiles includes at least one protrusion about which one band of the plurality of bands at least partially wraps.

17. The seat of claim 16, wherein each support tile of the plurality of support tiles comprises:

a connection tile attached to the at least some bands of the plurality of bands; and a contact tile secured to the connection tile, wherein the contact tiles cooperate to form a support surface configured to support a user and spanning at least a portion of the seat opening.

18. The seat of claim 16, wherein the frame and fabric assembly comprises:

a frame; and a fabric portion extending from the frame, wherein the suspension system is tensioned through direct or indirect interaction with the fabric portion.

19. The seat of claim 16, wherein each of the support tiles includes at least one aperture sized to accept one or more bands of the plurality of bands.

* * * * *